US008678989B2

(12) United States Patent
Rudman et al.

(10) Patent No.: US 8,678,989 B2
(45) Date of Patent: Mar. 25, 2014

(54) CENTRIFUGAL SEPARATOR SEPARATING DISC INTERSPACE CONFIGURATIONS

(75) Inventors: Lars Johan Rudman, Farsta (SE); Sven Olov Olsson, Huddinge (SE); Kjell Klintenstedt, Saltsjö-Boo (SE)

(73) Assignee: Alfa Laval Corporate AB, Lund (SE)

( * ) Notice: Subject to any disclaimer, the term of this patent is extended or adjusted under 35 U.S.C. 154(b) by 327 days.

(21) Appl. No.: 13/120,997

(22) PCT Filed: Sep. 30, 2009

(86) PCT No.: PCT/SE2009/051087
§ 371 (c)(1),
(2), (4) Date: Apr. 27, 2011

(87) PCT Pub. No.: WO2010/039099
PCT Pub. Date: Apr. 8, 2010

(65) Prior Publication Data

US 2011/0195832 A1 Aug. 11, 2011

(30) Foreign Application Priority Data

Sep. 30, 2008 (SE) ..... 0802062

(51) Int. Cl.
*B04B 7/14* (2006.01)
*B04B 1/08* (2006.01)

(52) U.S. Cl.
USPC ..... 494/73

(58) Field of Classification Search
USPC ..... 494/64, 67–73
See application file for complete search history.

(56) References Cited

U.S. PATENT DOCUMENTS

| | | | | | |
|---|---|---|---|---|---|
| 694,736 | A | * | 3/1902 | Gales | 494/73 |
| 1,006,622 | A | | 10/1911 | Bailey | |
| 2,028,955 | A | * | 1/1936 | Shenstone | 494/70 |
| 2,725,190 | A | * | 11/1955 | Hein et al. | 494/70 |
| 3,335,946 | A | * | 8/1967 | Putterlik | 494/73 |
| 4,142,671 | A | * | 3/1979 | Ivin et al. | 494/73 |

(Continued)

FOREIGN PATENT DOCUMENTS

| | | | |
|---|---|---|---|
| CH | 651764 | A5 * | 12/1978 |
| DE | 349709 | | 3/1922 |

(Continued)

OTHER PUBLICATIONS

International Preliminary Report on Patentability for PCT/SE2009/051086, dated Apr. 5, 2011.

*Primary Examiner* — Charles E Cooley
(74) *Attorney, Agent, or Firm* — MKG, LLC

(57) ABSTRACT

A separating disk for a disk package of a centrifuge rotor of a centrifugal separator has a tapering shape and extends around an axis of rotation and along a tapering rotary symmetric surface along the axis of rotation. There is an interspace between the separating disk and an adjacent separating disk. The separating disc has first protrusions extending outwardly from the tapering rotary symmetric surface and second protrusions extending inwardly from the tapering rotary symmetric surface. Each of the first and second protrusion are after each other in a peripheral direction and define a contact zone adapted to abut an adjacent separating disk in the disk package. The contact zones of the first protrusions are displaced in relation to the contact zones of the second protrusions seen in a normal direction with regard to the outer surface. Each contact zone has a continuously convex cross sectional shape.

15 Claims, 17 Drawing Sheets

(56) References Cited

U.S. PATENT DOCUMENTS

| | | | | |
|---|---|---|---|---|
| 4,262,841 | A * | 4/1981 | Berber et al. | 494/66 |
| 6,457,340 | B1 | 10/2002 | Kanemitsu et al. | |
| 8,549,890 | B2 * | 10/2013 | Klintenstedt et al. | 72/329 |
| 8,562,503 | B2 * | 10/2013 | Rudman et al. | 494/73 |
| 2008/0184763 | A1 | 8/2008 | Schroth et al. | |
| 2011/0195832 | A1 * | 8/2011 | Rudman et al. | 494/73 |
| 2011/0237417 | A1 * | 9/2011 | Rudman et al. | 494/70 |

FOREIGN PATENT DOCUMENTS

| | | | |
|---|---|---|---|
| DE | 363851 | | 11/1922 |
| EP | 1136149 | A2 | 6/2001 |
| SE | 2708 | | 2/1889 |
| SE | 19563 | | 8/1903 |
| SU | 423510 | | 7/1972 |
| WO | 9627445 | | 9/1996 |
| WO | 2007055630 | | 5/2007 |
| WO | 2007055630 | A1 | 5/2007 |

* cited by examiner

CENTRIFUGAL SEPARATOR SEPARATING DISC INTERSPACE CONFIGURATIONS

FIELD OF THE INVENTION

The present invention refers to a separating disk adapted to be included in a disk package of a centrifuge rotor of a centrifugal separator. The invention also refers to a disk package.

BACKGROUND OF THE INVENTION

Today separating disks for disk packages in centrifuge rotors are normally manufactured through pressure turning of plane disks to a desired tapering shape, for instance a conical shape. This method of manufacturing has the disadvantage that the manufacturing is expensive and time-consuming. Each separating disk has to be pressure turned individually in a pressure lathe. Another disadvantage of the pressure turning method is that it is difficult to produce irregular shapes such as protrusions in the pressure turned disk. A further disadvantage of the pressure turning method is the difficulty to achieve a sufficient surface smoothness without subsequent treatment of the surface. A poor surface smoothness can lead to deteriorated hygienic properties.

U.S. Pat. No. 2,028,955 discloses a disk package with conical separating disks of two kinds provided in an alternating order in such a way that every second disk is even and every second disk comprises a number of distance members in the form of substantially round projections or depressions in the disk. It does not appear how the tapering shape of the separating disk has been provided, but the projections and the depressions have been provided by means of some kind of press method. The projections and the depressions have a planar portion so that by this known technique, a large contact area is formed between the distance members and the surface of the adjacent separating disk. Furthermore, the projections and the depressions are provided in such a way that a projection is followed by a depression in a radial direction. According to U.S. Pat. No. 2,028,955 a projection also lies opposite to a depression of an adjacent disk in the disk package so that a pile of alternating projections and depressions is created through the disk package.

One problem with the solution disclosed in U.S. Pat. No. 2,028,955 is that the disk package during compression is relatively rigid since the relatively hard projections and depressions lies after each other in a radial direction in the disk package, and in addition opposite to each other. Consequently, no resilient portions of the separating disks are created, which could absorb a pretensioning force ensuring a tight abutment between the separating disks also during operation when the rotation may create forces striving to remove the disks from each other. A further disadvantage is that the distance members, and especially the depressions, may have a negative influence to the flow in the interspace in the separating disks.

SE-19563 discloses a separating disk adapted to be included in a disk package in a centrifuge rotor of a centrifugal separator. The separating disk extends around and axis of rotation and along a tapering rotary symmetric surface along the axis of rotation. The separating disk has an inner surface and an outer surface, and is manufactured of a material. The separating disk has a zigzag-like shape with first protrusions extending outwardly from the tapering rotary symmetric surface and second protrusions extending inwardly from the tapering symmetric surface. The first protrusions are displaced in relation to the second protrusions seen in a normal direction with regard to the outer surface. Wire elements are provided in order to create an interspace between adjacent separating disks in the disk package. It does not appear how the separating disk is manufactured.

DE-363851 discloses a separating disk adapted to be included in a disk package of a centrifuge rotor of a centrifugal separator. The separating disk extends around an axis of rotation and along a tapering rotary symmetric surface along the axis of rotation. The separating disk has an inner surface and an outer surface an is manufactured of a material. The separating disk is configured in such a way that it creates an interspace between the separating disk an adjacent separating disk in the disk package and comprises first protrusions extending outwardly from the tapering rotary symmetric shape and second protrusions extending inwardly from the tapering rotary symmetric shape. Each first and second protrusions defines a contact zone adapted to abut an adjacent separating disk in the disk package. The contact zone of the first protrusions are displaced in relation to the contact zones of the second protrusions seen in a normal direction with regard to the outer surface. The first and second protrusions are provided after each other in a peripheral direction of the separating disk. It does not appear how the separating disk is manufactured.

DE-349709 discloses a separating disk adapted to be included in a disk package of a centrifuge rotor of a centrifugal separator. The separating disk extends around an axis of rotation and along a tapering rotary symmetric surface along the axis of rotation. The separating disk has an inner surface and an outer surface, and is manufactured of a material. The separating disk is configured in such a way that it creates an interspace between the separating disk and an adjacent separating disk in the disk package, and comprises first protrusions extending outwardly from the tapering rotary symmetric surface and second protrusions extending inwardly from the tapering rotary symmetric surface. Each first and second protrusion defines a contact zone adapted to abut an adjacent separating disk in the disk package. The contact zones of the first protrusions and the second protrusions are provided after each other seen in a normal direction with regard to the outer surface. It does not appear how the separating disk is manufactured.

SE-2708 discloses a separating disk adapted to be included in a disk package of a centrifuge rotor of a centrifugal separator. The separating disk extends around an axis of rotation and along a tapering rotary symmetric surface along the axis of rotation. The separating disk has an inner surface and an outer surface, and is manufactured of a material. The separating disk is configured in such a way that it creates an interspace between the separating disk and an adjacent separating disk in the disk package, and comprises protrusions extending outwardly from the tapering rotary symmetric surface. Each protrusion defines a contact zone adapted to abut an adjacent separating disk in the disk package. The protrusions are provided after each other in a peripheral direction of the separating disk. It does not appear how the separating disk is manufactured.

SUMMARY OF THE INVENTION

One object of the present invention is to provide a separating disk which may be manufactured in an easy manner and to low costs. At the same time it is aimed at a separating disk that permits a uniform and tight abutment between the contact zones of the separating disks in a disk package.

The present invention resides in one aspect in a separating disk wherein the tapering shape and the protrusions of the separating disk have been provided through pressing of a blank of said material against a tool having a shape corresponding to the tapering shape with the protrusions of the pressed separating disk.

Such a separating disk can be readily manufactured since the pressing can be made in a press tool in a very short time-period. The subsequent work of attaching or shaping distance members disappears according to the invention, since it is possible to provide shape and distance creating means in the form of protrusions in one and the same pressing operation. The cost of manufacturing for each separating disk ought to be significantly lower than for the previously utilized pressure turning method. Furthermore, through such a pressing a deformation hardening of separating disks of a metal material is achieved so that a high strength, permitting use of thin blanks, is obtained.

According to an embodiment of the present invention, each contact zone has a continuously convex shape seen in a cross-section. Such a shape can advantageously be provided in a press tool. Such a shape also enables a small contact area to an adjacent separating disk in the disk package, i.e. the contact area approaches zero. The contact zone can be defined as forming a point or line abutment, or substantially a point or line abutment, against the inner surface or the outer surface of the adjacent separating disk. Such a minimized contact area results in good hygienic properties of the disk package since this is easy to clean. The minimized contact area significantly reduces the quantity of particles and microorganisms, such as bacteria, that can be attached in the area of the distance members.

According to a further embodiment of the present invention, the contact zones of the first and second protrusions are provided at a significant distance from each other. Advantageously, the contact zone of a first protrusion may be located in the centre between the contact zone of two second protrusions.

According to a further embodiment of the present invention, the protrusions have such an extension in the peripheral direction that each first protrusion adjoins, or adjoins directly, two adjacent second protrusions.

According to a further embodiment of the present invention, the protrusions have such an extension in the peripheral direction that each first protrusion and second protrusion adjoins a portion lacking protrusions and extending along the tapering rotary symmetric surface.

According to a further embodiment of the present invention, each first protrusion is provided directly adjacent to one of the second protrusions in the peripheral direction. Advantageously, the first protrusion may form a channel-like depression of the inner surface, wherein this depression is configured to permit collection and transport of one of said components radially outwardly or inwardly on the inner surface. Furthermore, the second protrusion may form a channel-like depression on the outer surface, wherein this configured to permit collection and transport of one of said components radially outwardly or inwardly on the outer surface.

According to a further embodiment of the present invention, the first and second protrusions have an extension from in the proximity of the inner edge to in the proximity of the outer edge. The extension of at least some of the first and second protrusions may be straight and/or curved.

The object is also achieved by the initially defined disk package, characterized in that the tapering shape and the protrusions of the separating disk have been provided through pressing of a blank of said material against a tool part having a shape corresponding to the tapering shape with the protrusions of the pressed separating disk.

According to an embodiment of the disk package, the first and second separating disks are provided in an alternating order in the disk package. Advantageously, the second separating disks may lack protrusions from the rotary symmetric surface. Furthermore, the second separating disks may be provided with a plastically deformed portion against which the contact zone of one of the first and/or second protrusions abuts.

BRIEF DESCRIPTION OF THE DRAWINGS

The invention is now to be explained through a description of various embodiments and with reference to the drawings attached hereto.

DETAILED DESCRIPTION OF VARIOUS EMBODIMENTS OF THE INVENTION

Figure 1:
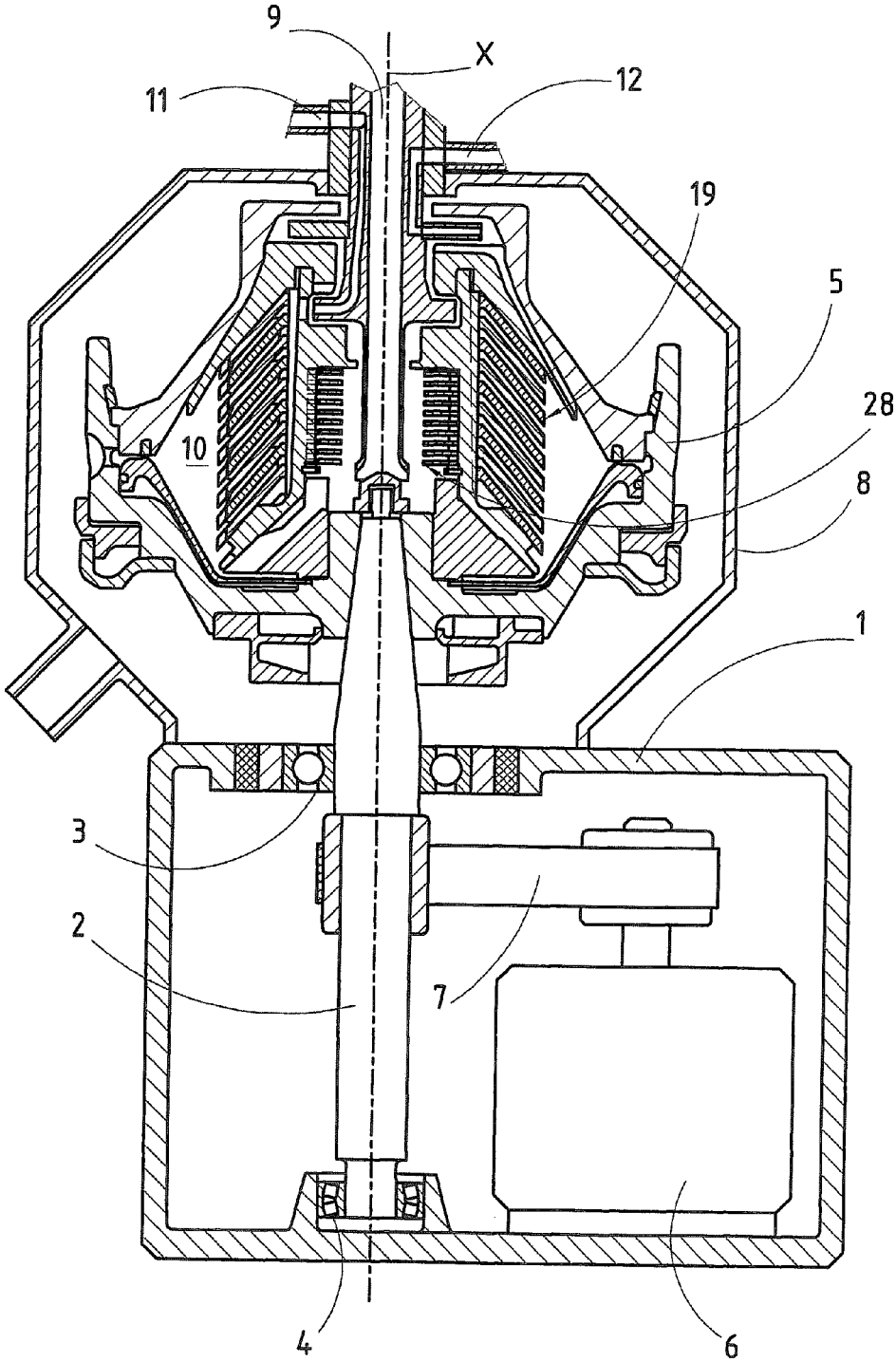
FIG. 1 discloses a partly sectional side view of a centrifugal separator with a centrifuge rotor.

FIG. 1 discloses a centrifugal separator which is adapted for separation of at least a first component and a second component of a supplied medium. It is to be noted that the disclosed centrifugal separator is disclosed as an example and that the configuration thereof may be varied. The centrifugal separator comprises a frame 1, which may be non-rotatable or stationary, and a spindle 2 which is rotably journalled in an upper bearing 3 and a lower bearing 4. The spindle 2 carries a centrifuge rotor 5 and is arranged to rotate together with the centrifuge rotor 5 around an axis x of rotation in relation to the frame 1. The spindle 2 is driven by means of a drive member 6 which is connected to the spindle 2 in a suitable manner in order to rotate the latter at a high velocity, for instance via a drive belt 7 or a gear transmission, or through direct drive, i.e. the rotor (not disclosed) of the drive member 6 is directly connected to the spindle 2 or the centrifuge rotor 5. It is to be noted here that elements having the same function has been provided with identical reference signs in the various embodiments to be described.

The centrifugal separator may comprise a casing 8 which is connected to the frame 1 and which encloses the centrifuge rotor 5. Furthermore, the centrifugal separator comprises at least one inlet 9, which extends through the casing 8 and into a separation space 10 which is formed by the centrifuge rotor 5 for feeding of the medium to be centrifuged, and at least a first outlet for discharged from the separation space 10 of the first component which has been separated from the medium and a second outlet for discharge from the separation space 10 of the second component which has been separated from the medium.

In the separation space 10, there is a disk package 19 which rotates with the centrifuge rotor 5. The disk package 19 comprises or is assembled of a plurality of separating disks 20 which are piled onto each other in the disk package 19, see FIG. 2. A separating disk 20 according to a first embodiment is disclosed more closely in FIGS. 3 and 4. Each separating disk 20 extends around the axis x of rotation and rotates around the axis x of rotation in a direction R of rotation. Each separating disk 20 extends along a rotary symmetric, or virtually rotary symmetric, surface y, see FIG. 5, which tapers along the axis x of rotation, and has a tapering shape along the axis x of rotation with an outer surface 21, which is convex, and an inner surface 22, which is concave. The tapering shape of the separating disks 20 may also be conical or substantially conical, but it is also possible to let the tapering shape of the separating disks 20 have a generatrix which is curved inwardly or outwardly. The separating disks 20 thus have an angle $\alpha$ of inclination in relation to the axis x of rotation, see FIG. 2. The angle $\alpha$ of inclination may be 20-70°. Each separating disk 20 also has an outer edge 23 along the radially outer periphery of the separating disk 20 and an inner edge 24 which extends along the radially inner periphery of the separating disk 20 and defines a central opening of the separating disk 20.

Figure 5:
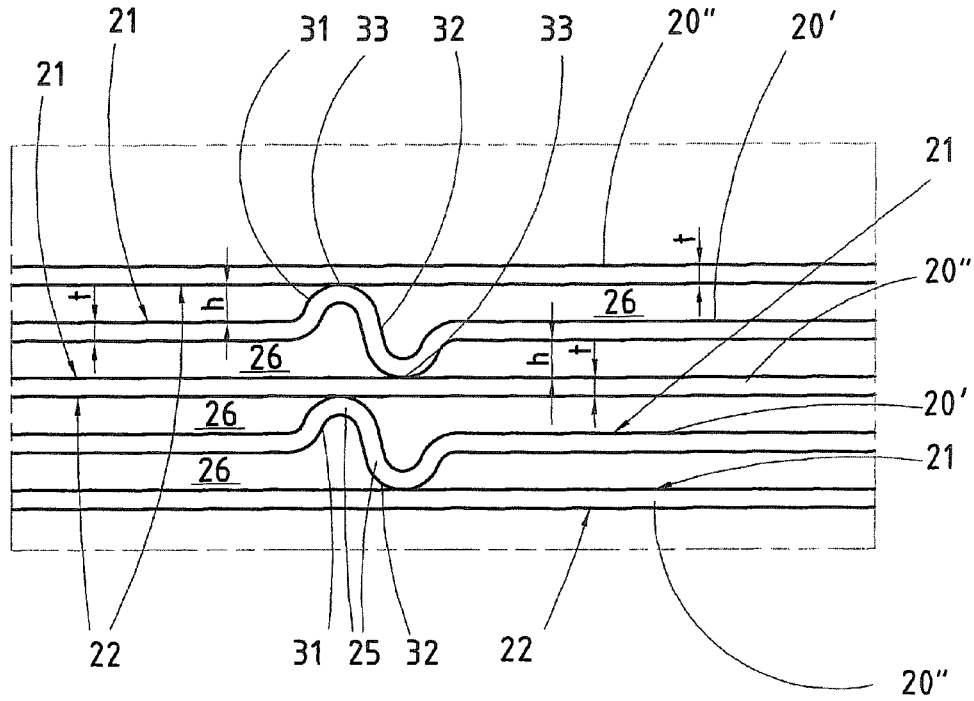
FIG. 5 discloses a section through the disk package in FIG. 2.

Between the separating disks 20, there are distance members 25 which are provided on the outer surface 21 and/or the inner surface 22 and arranged to ensure the formation of an interspace 26 between adjacent separating disks 20 in the disk package 19, see FIG. 5. Each separating disk 20 comprises, according to the first embodiment, at least one portion without distance members 25 on the outer surface 21 and/or the inner surface 22. The separating disks 20 may be provided around a so called distributor 27. The separating disks 20 are compressed against each other in the disk package 19 with a pre-tensioning force in such a way that the distance members 25 of a separating disk abuts sealingly an adjacent separating disk 20, especially against the above mention portion of an adjacent separating disk 20. The separating disks 20 may also be fixedly connected to each other, for instance through brazing.

Figure 2:
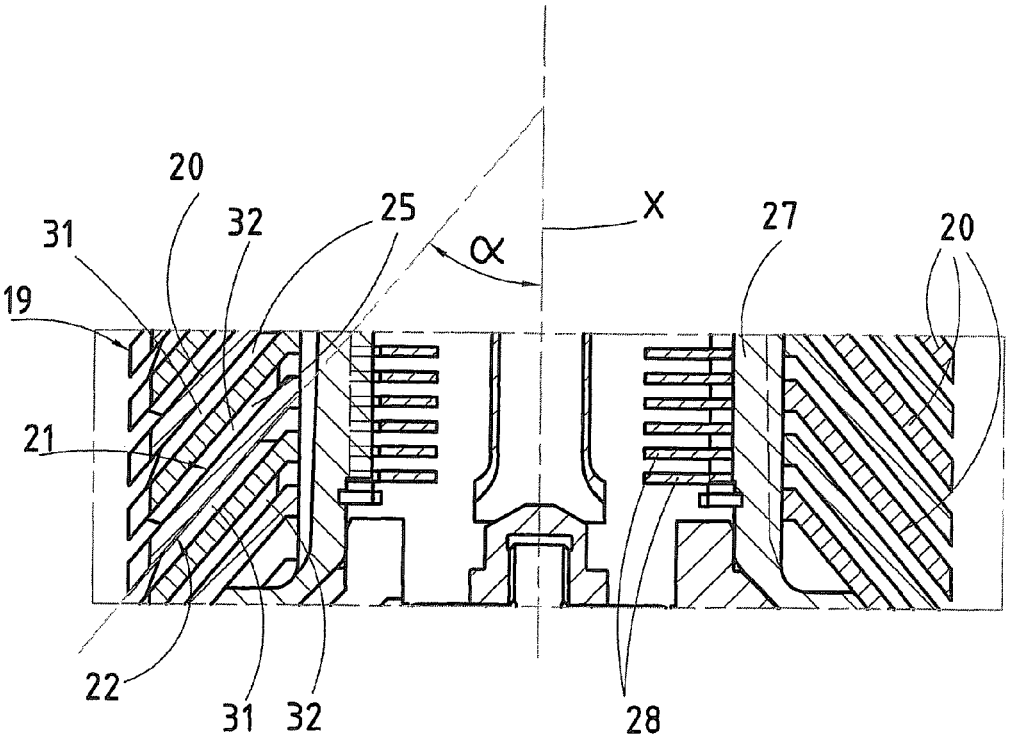
FIG. 2 discloses a sectional side view through a disk package of the centrifugal separator in FIG. 1.

As can be seen in FIGS. 1 and 2, the centrifuge rotor 5 also comprises a number of inlet disks 28 which are centrally provided in the distributor 27. These inlet disks 28 may be manufactured in a similar manner as the separating disks 20. The inlet disks 28 may be plane, as disclosed in FIGS. 1 and 2, or conical. The inlet disks 28 may have distance members with a similar configuration as the distance members 25 of the separating disks 20.

The tapering shape of the separating disks 20 has been provided through pressing of a blank of a material against a tool part. The material may be any pressable material, for instance metal material, such as steel, aluminium, titanium, various alloys etc., and also suitable plastic materials. The tool part to be described more closely below has a shape corresponding to the tapering shape of the pressed separating disk 20. It is to be noted, however, that the separating disks 20 as a consequence of such a pressing may obtain a thickness t that varies with the distance from the axis x of rotation.

Figure 4:
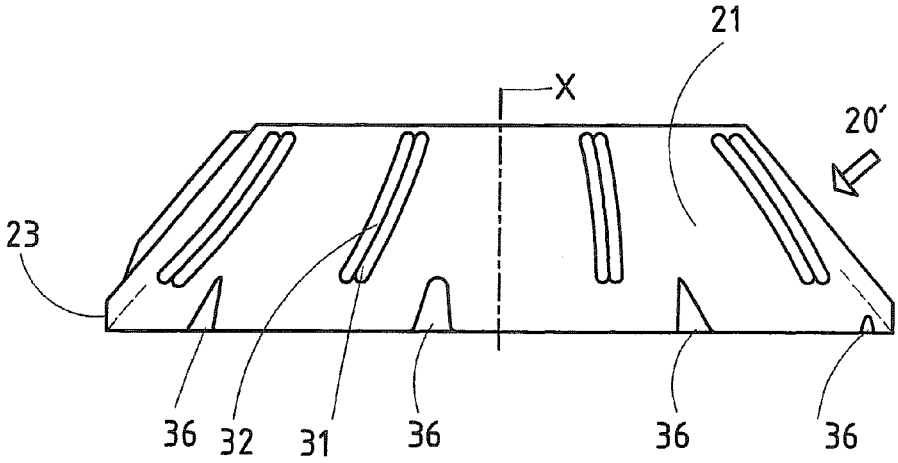
FIG. 4 discloses a side view of the separating disk in FIG. 3.
Figure 3:
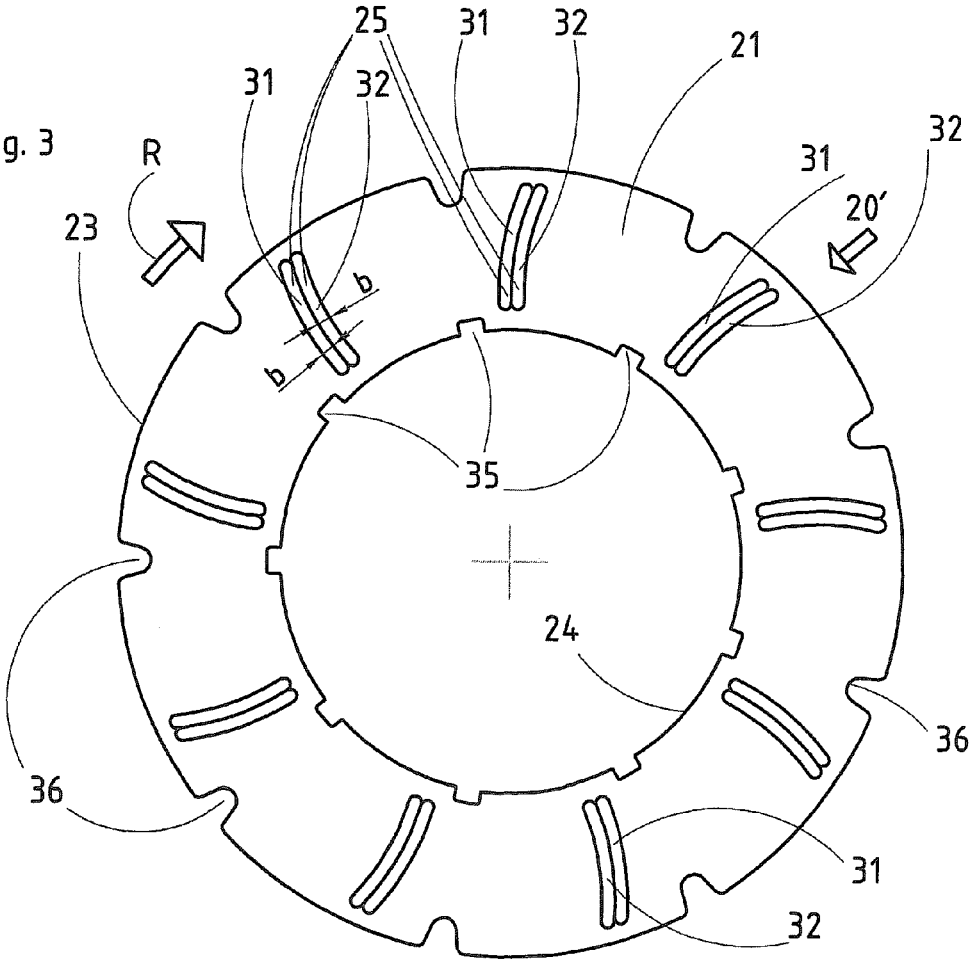
FIG. 3 discloses a view from above of a separating disk of the disk package according to a first embodiment.

In the first embodiment disclosed more closely in FIGS. 3, 4 and 5, the distance members 25 are formed as protrusions in the material, wherein the tapering shape and the protrusions of the separating disk 20 have been produced through pressing of the blank against the tool part having a shape corresponding to the tapering shape with the protrusions of the pressed separating disk 20. In the first embodiment the distance members 25 comprise first distance members 25 in the form of first protrusions 31 and second distance members 25 in the form of second protrusions 32. The protrusions thus comprise a number of pairs of protrusions, wherein each of the pairs comprises a first protrusion 31 extending away from the rotary symmetric surface y and away from the outer surface 21 and a second protrusion 32 extending away from the rotary symmetric surface y and away from the inner surface 22. The first and second protrusions 31, 32 are displaced in relation to each other seen in a normal direction with regard to the outer surface 21. In the first embodiment disclosed, the first and second protrusions 31, 32 are provided adjacent, or directly adjacent, to each other in a peripheral direction of the separating disk 20. It is possible to provide the distance members 25, i.e. in the embodiments disclosed the first and second protrusions 31, 32, in each pair at a significant distance from each other, for instance in such a way that a first protrusion 31 is located at the centre between two second protrusions 32. Possibly, the protrusions 31, 32 may then be given a more wide shape and in an extreme case extend substantially straight from the peak of a first protrusion 31 to the peak of the adjacent second protrusions 32, which means that there is no marked beginning or marked end of the distance members 25, see also FIGS. 8 and 9.

As can be seen in FIG. 5, the first protrusion 31 abuts the inner surface 22 of the adjacent separating disk 20, whereas the second protrusion 32 abuts the outer surface 21 of an adjacent separating disk 20. The first protrusion 31 will thus form a channel-like depression of the inner surface 22 and this depression is configured to collect and transport one of said components radially outwardly or inwardly on the inner surface 22. The second protrusion 32 forms, in a corresponding manner, a channel-like depression of the outer surface 21, wherein this depression is configured to collect and transport one of said components radially outwardly or inwardly on the outer surface 21. In the first embodiment, the second protrusion 32 is located after the first protrusion 31 with regard to the direction R of rotation. With regard to the outer surface 21, the channel-like depression thus precedes the upwardly projecting first protrusion 31. With regard to the inner surface 22, the channel-like depression instead follows the downwardly projecting second protrusion 32. Inverted relations arise if the direction of rotation is the opposite.

The first and second protrusions 31 and 32 have a height h above the outer surface 21 and the inner surface 22, respectively, see FIG. 5. This height h determines also the height of the interspaces 26 between the separating disks 20 in the disk package 19. Since the thickness t of the separating disks 20 may vary with the distance from the axis x of rotation, the first and second protrusions 31 and 32 may advantageously be configured in such a way that the height h varies with the distance from the axis x of rotation. As can be seen in FIG. 3, the distance members 25, i.e. the first and second protrusions 31 and 32, have an extension from a radially inner position to a radially outer position, wherein the height h varies along this extension in such a way that this varying height compensates for the varying thickness. In such a way a tight and uniform abutment between the first and second protrusions 31 and 32 against the inner surface 22 and the outer surface 21, respectively, can be ensured along the whole or substantially the whole extension of the protrusions 31, 32.

Depending on the actual press method, the thickness t of the separating disk 20 may increase with an increasing distance from the axis of rotation, wherein the height h decreases with an increasing distance from the axis x of rotation. The thickness t of the separating disk 20 may also decrease with an increasing distance from the axis x of rotation, wherein the height of the distance members 25 increases with an increasing distance from the axis x of rotation. It is to be noted that the varying height h can be provided in an advantageous manner since the separating disks 20 are manufactured in a press method and pressed against a tool part with a corresponding shape. The tool part can thus have projections and depressions, respectively, which are configured for the formation of the protrusions, and which have been given a varying height h in accordance with the applied press method in connection with the tool manufacturing.

The press method also makes it possible in an easy manner to let the extension of the protrusions 31, 32 be straight and radial or substantially radial, straight but inclined in relation to a radial direction, or curved at least if the protrusions 31, 32 are seen in the direction of the axis x of rotation. In the first embodiment the extension of the protrusions 31, 32 extends from in the proximity of the inner edge 24 to in the proximity of the outer edge 23, and more precisely to just inside the inner edge 24 and outer edge 23, respectively.

Figure 3A:
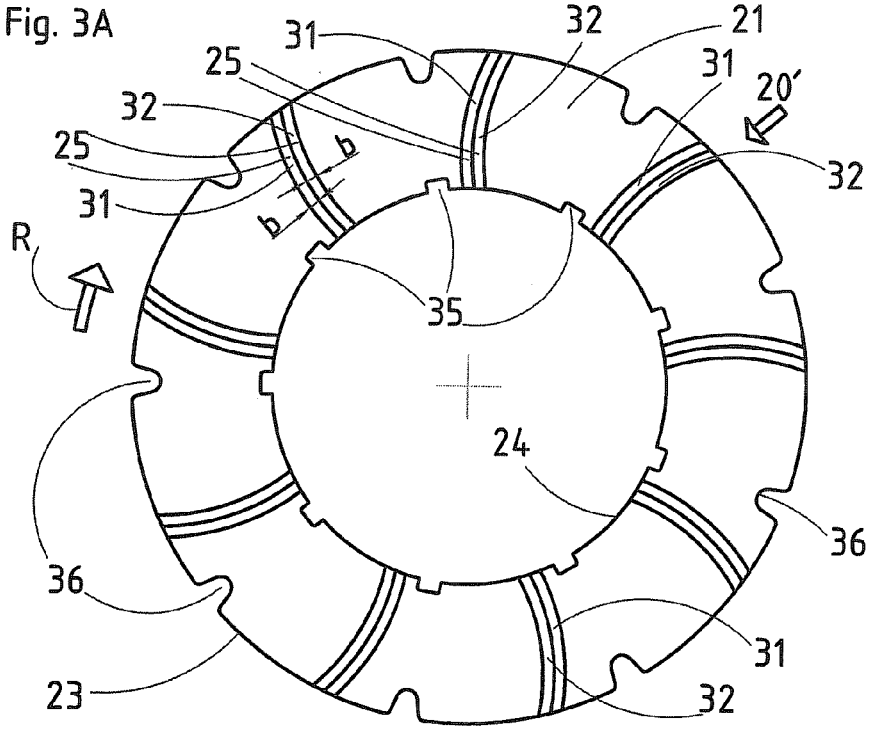
FIG. 3A discloses a view from above of a first variant of the separating disk according to the first embodiment.

FIG. 3A discloses a first variant of the separating disk according to the first embodiment. According to this variant, the protrusions 31, 32 extend up to the inner edge 24 and to the outer edge 23. It is to be noted that it is also possible to let the protrusions 31, 32 extend up to only one of the inner edge 24 and the outer edge 23.

Figure 3B:
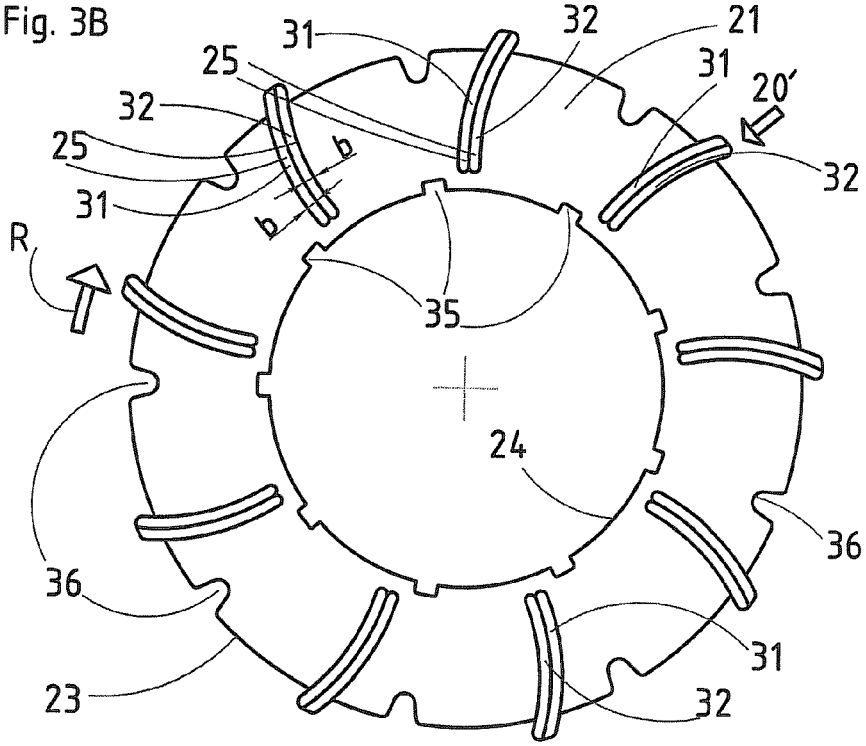
FIG. 3B discloses a view from above of a second variant of the separating disk according to the first embodiment.

FIG. 3B discloses a second variant of the separating disk according to the first embodiment. According to this variant, the protrusions 31, 32 extend to in the proximity of the inner edge 24, and beyond, or out over, the outer edge 23. In such a way means are created for influencing the behaviour of the separated component when it has left the separating disk 20 proper. It is possible according to this variant to let the protrusions 31, 32 extend up to the inner edge as disclosed in FIG. 3A. It is also possible to let only one of the protrusions 31, 32 extend beyond the outer edge 23. As a further alternative, it is possible to create a projecting portion (not disclosed in the figures), of the separating disk 20, which portion extends beyond the outer edge 23 and is provided beside the protrusions 31, 32.

The press method also makes it possible to configure the distance members 25, i.e. the first and second protrusions 31, 32, with a width at the inner surface and/or the outer surface 21 seen in a normal direction to the inner surface or the outer surface 21, wherein this width of at least some of the distance members 25 varies with the distance from the axis x of rotation.

Furthermore, the press method also enables the formation of stiffening folds or embossings (not disclosed) of the separating disks 20. Such folds may be straight or curved or extend in suitable directions, and have a strengthening effect.

Each of the first and second protrusions 31 and 32 comprises at least one contact zone 33 intended to abut the inner surface 22 and the outer surface 21, respectively, of an adjacent separating disk 20 in the disk package 19. As can be seen in FIG. 5, the contact zone 33 has a continuously convex shape seen in a cross section, in the first embodiment in a cross section transversally to a substantially radial direction. In the first embodiment, the contact zone 33 extends along the whole, or substantially the whole, extension of the first and second protrusions 31 and 32. With such a continuously convex shape of the contact zone 33 a small contact area between the contact zone 33 and the adjacent separating disk 20 is ensured, i.e. the contact area approaches zero. The contact zone 33 may in the first embodiment be defined to form a line abutment, or substantially a line abutment, against the inner surface 22 and the outer surface 21 respectively, of the adjacent separating disk 20 along the whole extension of the protrusions 31 and 32.

As can be seen in FIGS. 2 and 5, the separating disks 20 comprise first separating disk 20' and second separating disks 20". The first separating disks 20' comprise the first and second protrusions 31 and 32 which have been described above. The second separating disks 20" lack such protrusions, i.e. they comprise, or consist of, only one of the above mentioned portion without distance members 25. The second separating disks 20" thus have an even, or substantially even, tapering shape. The first and second separating disks 20' and 20" are provided in an alternating order in the disk package 19, i.e. every second separating disk 20 is a first separating disk 20' and every second separating disk is a second separating disk 20".

As can be seen in FIG. 3, each separating disk 20 comprises one or several recesses 35 along the inner edge 24. Such recesses may have the purpose of enabling a polar-positioning of the separating disks 20 in the disk package 19. Furthermore, each separating disk 20 comprises one or several recesses 36 along the outer edge 23. The recesses 36 may have the purpose of permitting transport of the medium through the disk package 19 and feeding of the medium into the different interspaces 26. It is to be noted that the recesses 35 and 36 may be advantageous for reducing the inherent stresses in the material in the pressed separating disk 20. The recesses 36 may be replaced by holes which in a manner known per se extend through the separating disk 20 and are provided at a distance from the inner and the outer edges 24, 23.

The separating disks 20 are polar-positioned in such a way that the first protrusions 31 of the first separating disks 20' are in line with each other in the disk package 19 seen in the direction of the axis x of rotation, see FIG. 5. Such a configuration of the disk package 19 is advantageous since it makes it possible to include a pre-tensioning in the disk package 19 when it is mounted. The second separating disks 20" will during the compressing of the disk package 19 be deformed elastically alternately upwardly and downwardly by the first and second protrusions 31 and 32 of the adjacent separating disks 20'. During operation of the centrifugal separator, forces arise in the second separating disks 20", which forces strive to straighten out the elastic deformation. Consequently, the abutment force between the separating disks 20 in the disk package 19 increases. In the embodiment disclosed, the first and second separating disks 20' and 20" have the same thickness t. However, it is to be noted that the first and second separating disks 20' and 20" may have different thicknesses t. Especially, the second separating disks 20", which lack protrusions, may have a thickness t which is significantly smaller than the thickness t of the first separating disks 20'. It is also to be noted that the height h of each distance member 25 of a first separating disk 20' varies in such a way that it compensates for the varying thickness t of the first separating disk 20' and for the varying thickness t of an adjacent second separating disk 20".

Figure 6:
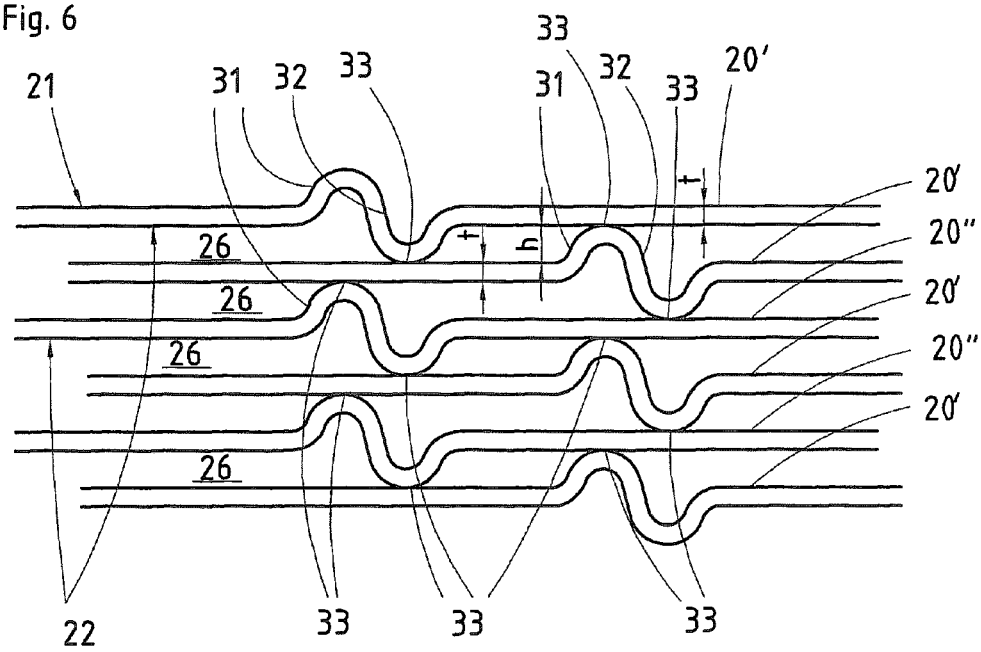
FIG. 6 discloses a section similar to the one in FIG. 5 of a part of a disk package according to a second embodiment.

According to a second embodiment of the disk package 19, see FIG. 6, also each second separating disk 20" may comprise a number of distance members in the form of pressed first and second protrusions 31 and 32, i.e. all separating disks 20 are provided with first and second protrusions 31 and 32. In this case, the separating disks 20 mat be polar-positioned in such a way that a first protrusions 31 of the first separating disks 20' are displaced in relation to the first protrusions 31 of the second separating disks 20" in the disk package 19 seen in the direction of the axis x of rotation.

Figure 7:
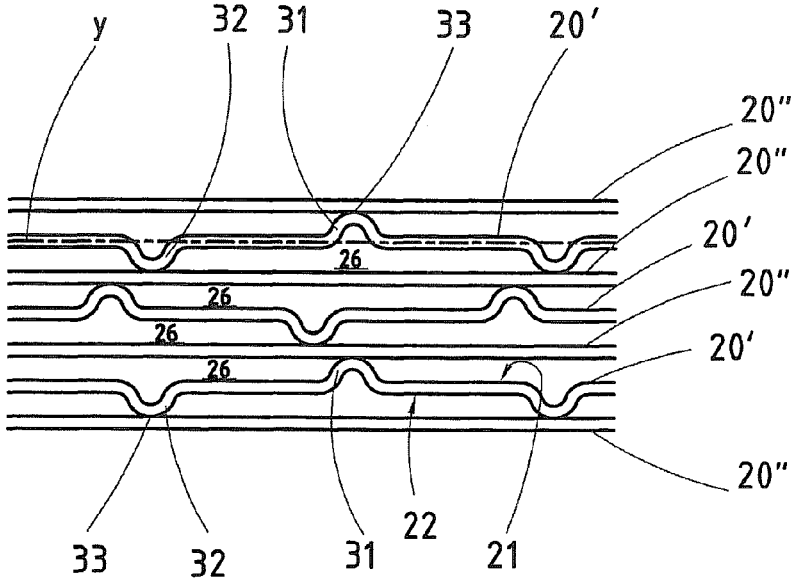
FIG. 7 discloses a view similar to the one in FIG. 5 of a separating disk according to a third embodiment.

FIG. 7 discloses a third embodiment where the distance members 25, i.e. the protrusions 31, 32, have such an extension in the peripheral direction that each first protrusion 31 and second protrusion 32 adjoins a portion lacking protrusions and extending along the tapering rotary symmetric surface y. The contact zones 33 of the first protrusions 31 are provided at a significant distance from the contact zones 33 of the second protrusions 31, 32. Especially for the third embodiment, the contact zone 33 of a first protrusion 31 is located in the centre between the contact zone 33 of two second protrusions 32.

Figure 8:
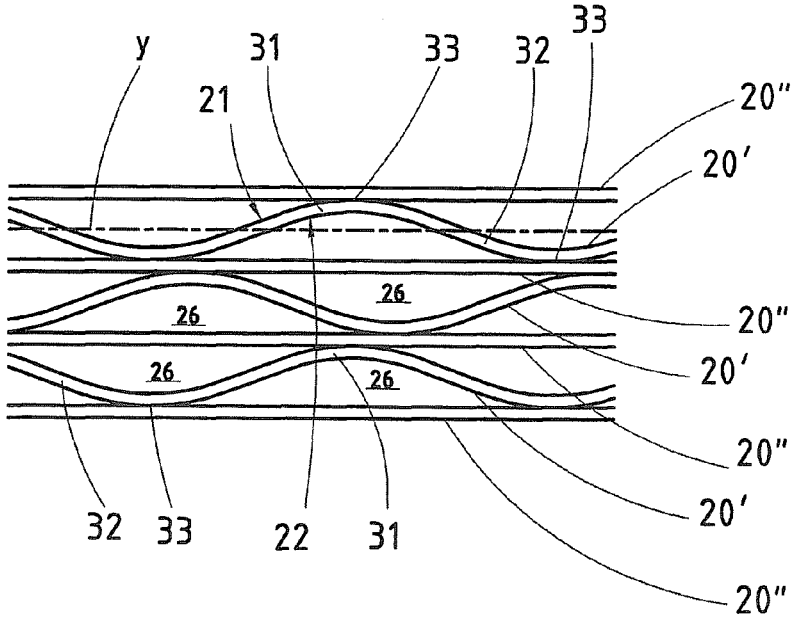
FIG. 8 discloses a view similar to the one in FIG. 5 of a separating disk according to a fourth embodiment.

FIG. 8 discloses a fourth embodiment of a pressed separating disk 20, which differs from the third embodiment in that the first and second protrusions 31, 32 have such an extension in the peripheral direction that each first protrusion 31 adjoins, or adjoins directly, two adjacent second protrusions 32. The separating disk 20 has in this embodiment thus a continuous, or substantially continuous, wave-shape in relation to the rotary symmetric surface y, seen in a cross-section. Protrusions with such an extension in the peripheral direction can be obtained by means of a relatively small press force.

Figure 9:
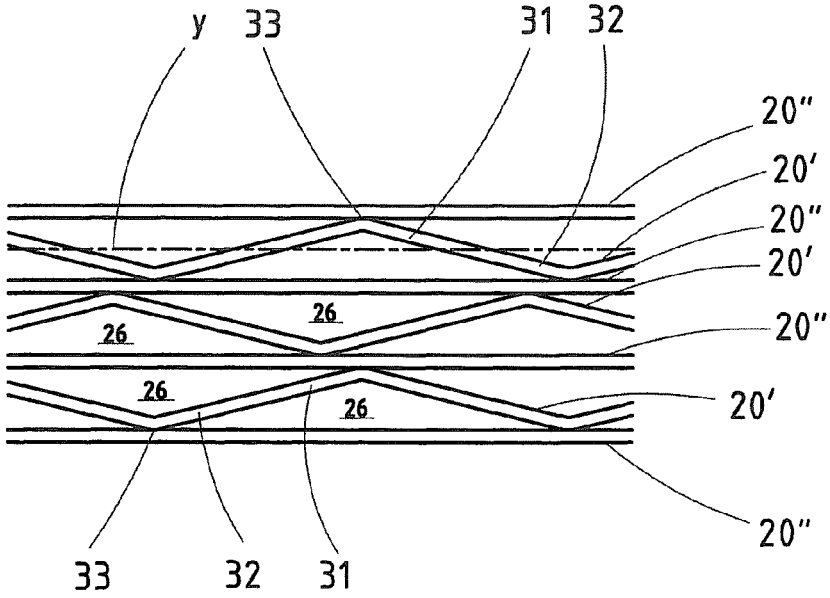
FIG. 9, 9A disclose a section similar to the one in FIG. 5 of a separating disk according to a fifth embodiment.
Figure 9A:
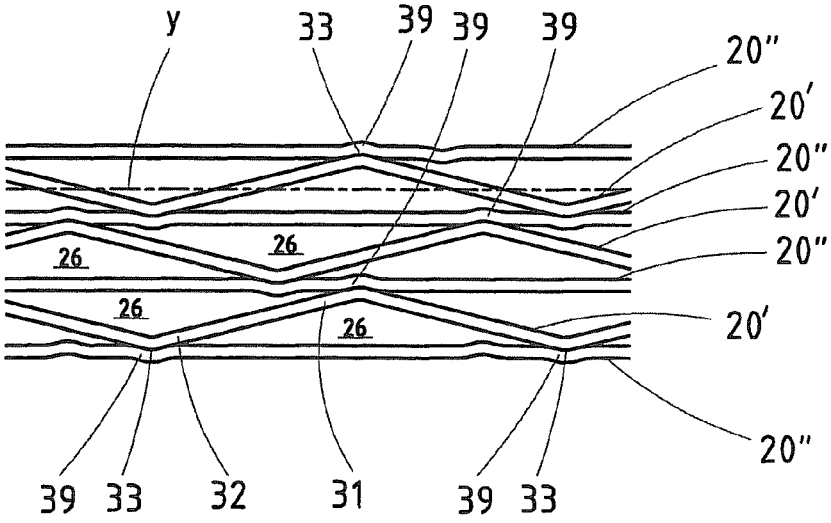

FIG. 9 discloses a fifth embodiment, similar to the fourth embodiment, but where the protrusions 31, 32 have zigzag-shaped extension seen in a cross-section. As in the fourth embodiment, each first protrusion 31 adjoins directly two second protrusions 32 without any intermediate portion which is parallel with the rotary symmetric surface y. A variant of this embodiment is disclosed in FIG. 9A where the second separating disks 20" or the portions without distance members of the separating disks 20 are provided with plastically deformed portions 39 where the contact zone 33 of a first and/or second protrusion 31, 32 abuts or is intended to abut. The height of these plastically deformed portions 39 is significantly lower than the height of the first and second protrusions 31, 32 of the first separating disks 20'. In such a way, a secure positioning of the separating disks 20 in relation to each other is created. Such plastically deformed portions 39 may also be applied on separating disks in the embodiments disclosed in FIGS. 5, 6 and 7, for instance.

Figure 10:
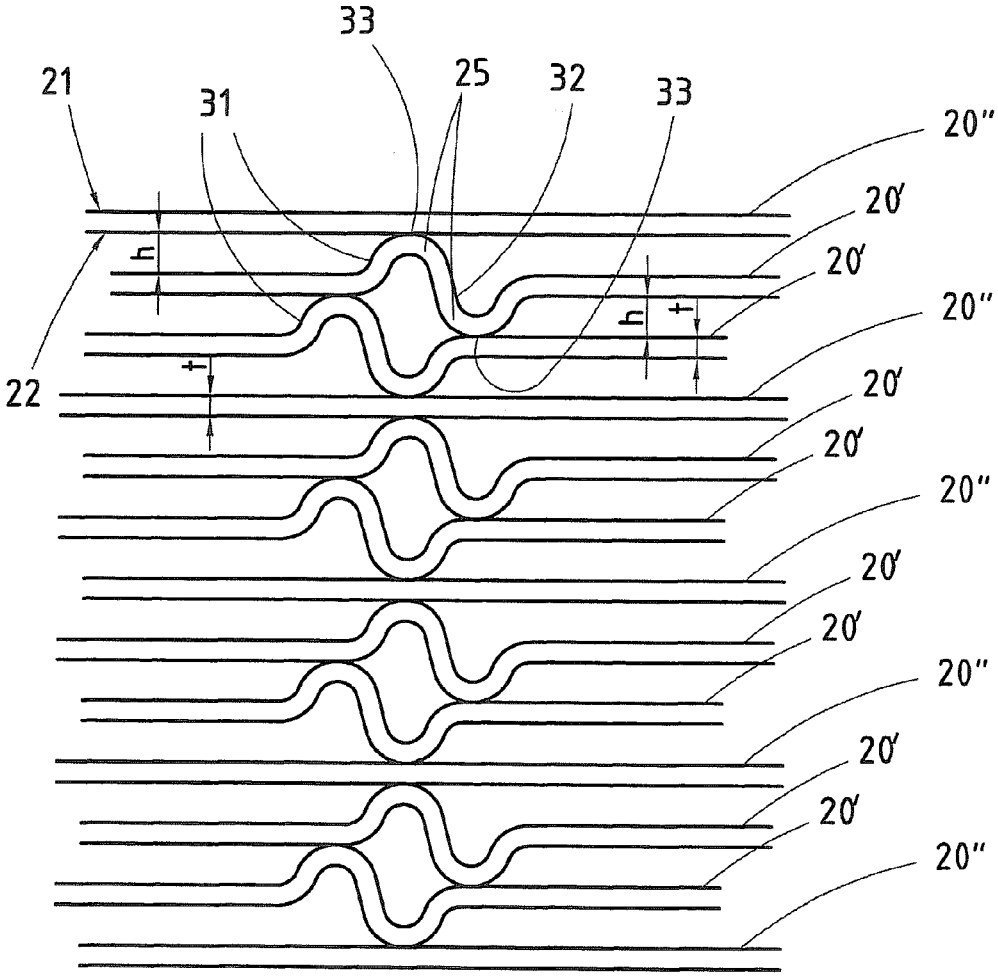
FIG. 10 discloses a section similar to the one in FIG. 5 through a disk package with separating disks according to a sixth embodiment.

It is to be understood that the polar-positioning of the separating disks 20 may be varied in many different ways in addition to the ways disclosed in FIGS. 5 and 6. FIG. 10 discloses a sixth embodiment where two first separating disks 20' are provided beside each other and each such pair of first separating disks 20' are separated by a second separating disk 20". The first protrusion 31 of a first separating disk 20' in such a pair lies opposite to the second protrusion 32 of the second first separating disk 20' in this pair, and opposite the first protrusions 31 of corresponding disks 20' in the remaining pairs.

Figure 11:
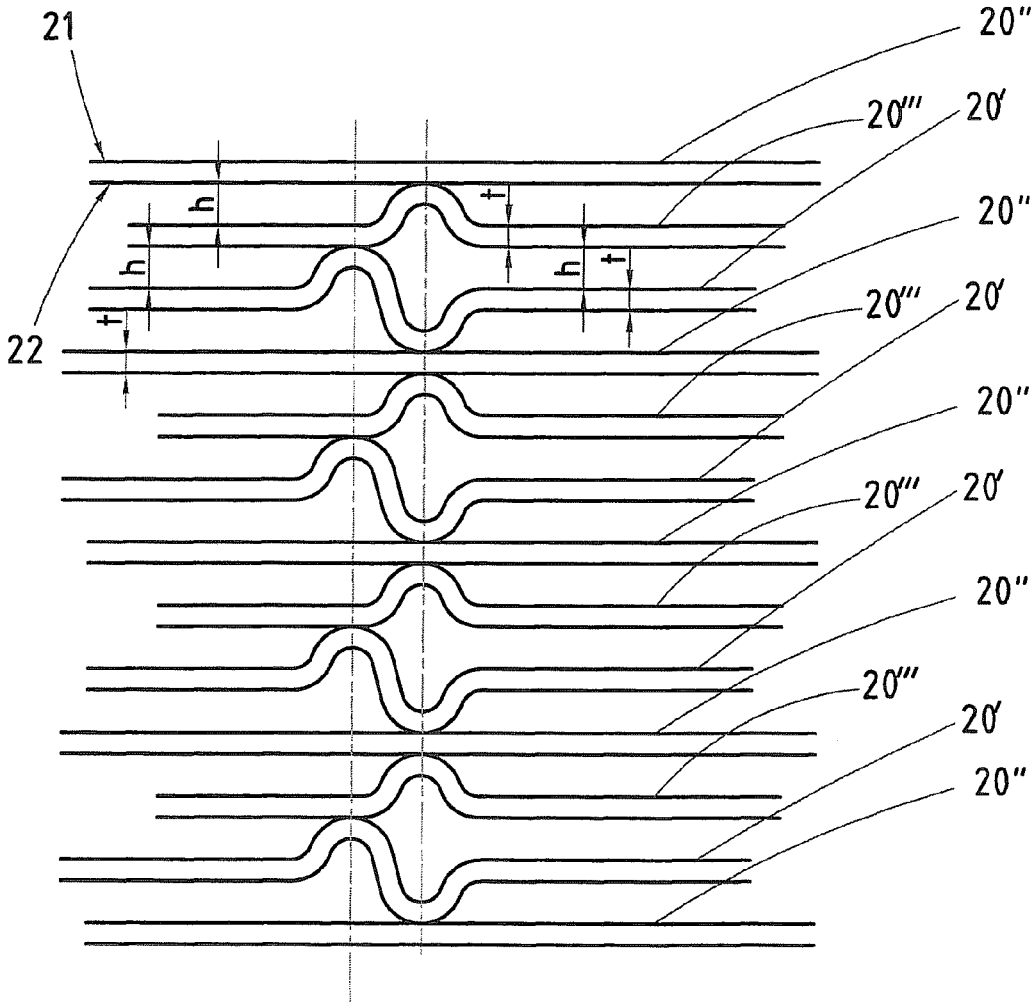
FIG. 11 discloses a section similar to the one in FIG. 5 through a disk package with separating disks according to a seventh embodiment.
Figure 12:
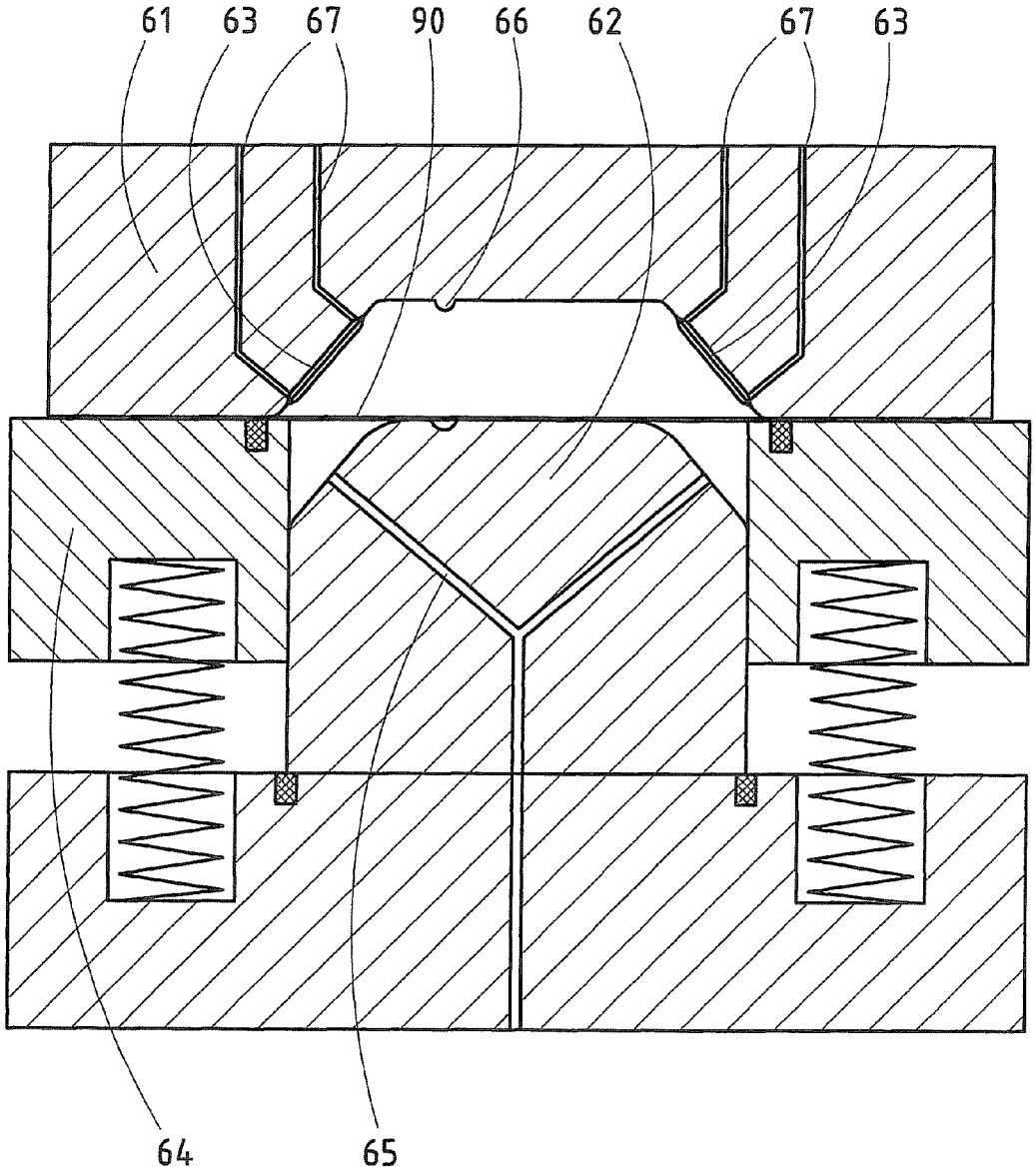
FIG. 12-14 discloses a sectional view of a first variant of a press tool for pressing a separating disk.
Figure 13:
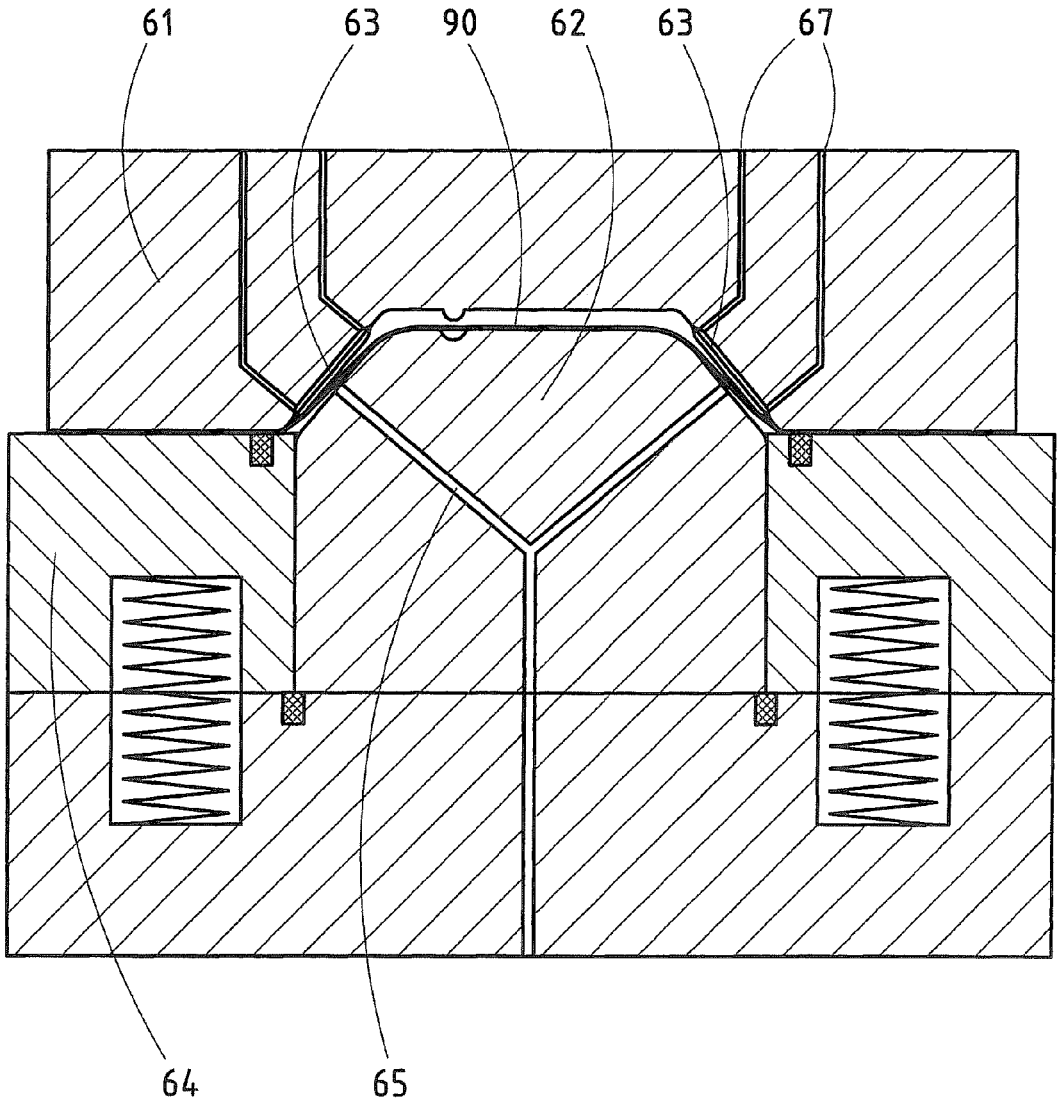
Figure 14:
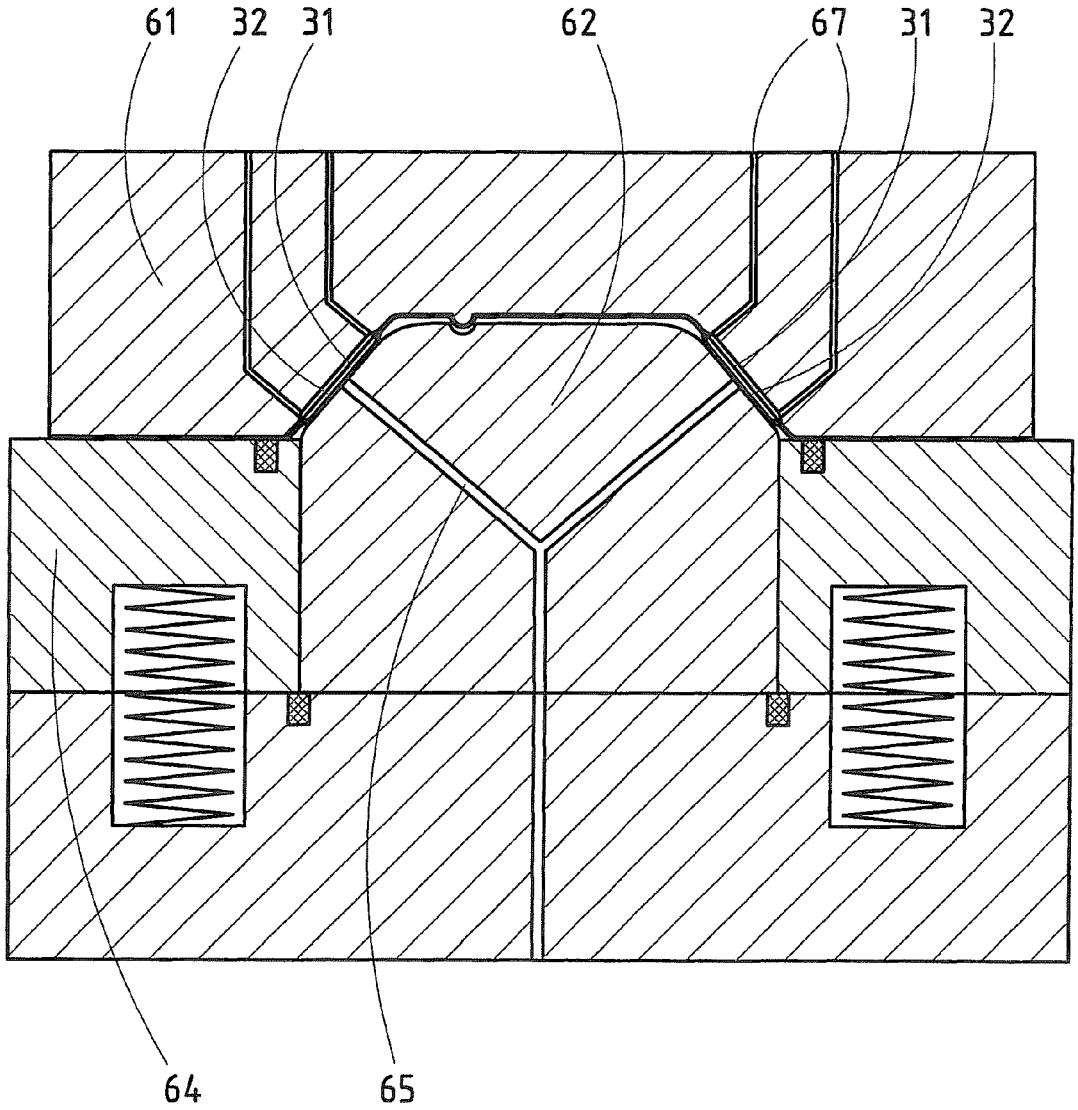

FIG. 11 discloses a seventh embodiment which is similar to the sixth embodiment, but differs from the latter since one of the first separating disks 20' has been modified and is a third separating disk 20'" which comprises a first protrusion 31 but no second protrusion 32. The first protrusion 31 of the third separating disk in each pair lies opposite to the second protrusion 32 of the first separating disk 20' in each pair. In the sixth embodiment, a space which is closed in a cross-section is formed. Thanks to the absence of the second protrusion 32 of the third separating disk 20'", a lateral opening into this space is formed. It may also be mentioned that this closed space disclosed in FIG. 10 may be open at the ends through a variation of the length of the protrusions along their extension.

FIGS. 12 to 15 disclose a first variant of a press tool for manufacturing a separating disk as defined above. The press tool is intended to be introduced into a press (not disclosed) of a suitable design. The press tool comprises a first tool part 61 and a second tool part 62. The first tool part 61 has a concave shape against which the outer surface 21 of the separating disk 20 abuts after finished pressing. The first tool part 61 has a substantially plane bottom surface and a surrounding tapering side surface, in the example disclosed a surrounding substantially conical side surface. The first tool part 61 thus have a shape corresponding to the tapering shape of the pressed separating disk 20. In the case that the separating disk 20 is provided with protrusions 31, 32, 50, the first tool part 61 also comprises first from elements 63 which are located on the surrounding tapering side surface and which correspond to the shape of these protrusions, in the disclosed press tool, the protrusions 31 and 32. The press tool comprises, or is associated with, a holding member 64, which is arranged to hold the blank 90 to be pressed against the first tool part 61 with a holding force. If the separating disk 20 lacks protrusions a first tool part 61 without first form elements 63 is used.

Furthermore, the press tool comprises a supply device arranged to permit supply of a liquid at a pressure between the blank 90 and the second tool part 62. The supply device comprises channels 65 extending through the second tool part 62 through the surface of the second tool part 62 which faces the blank 90.

Figure 15:
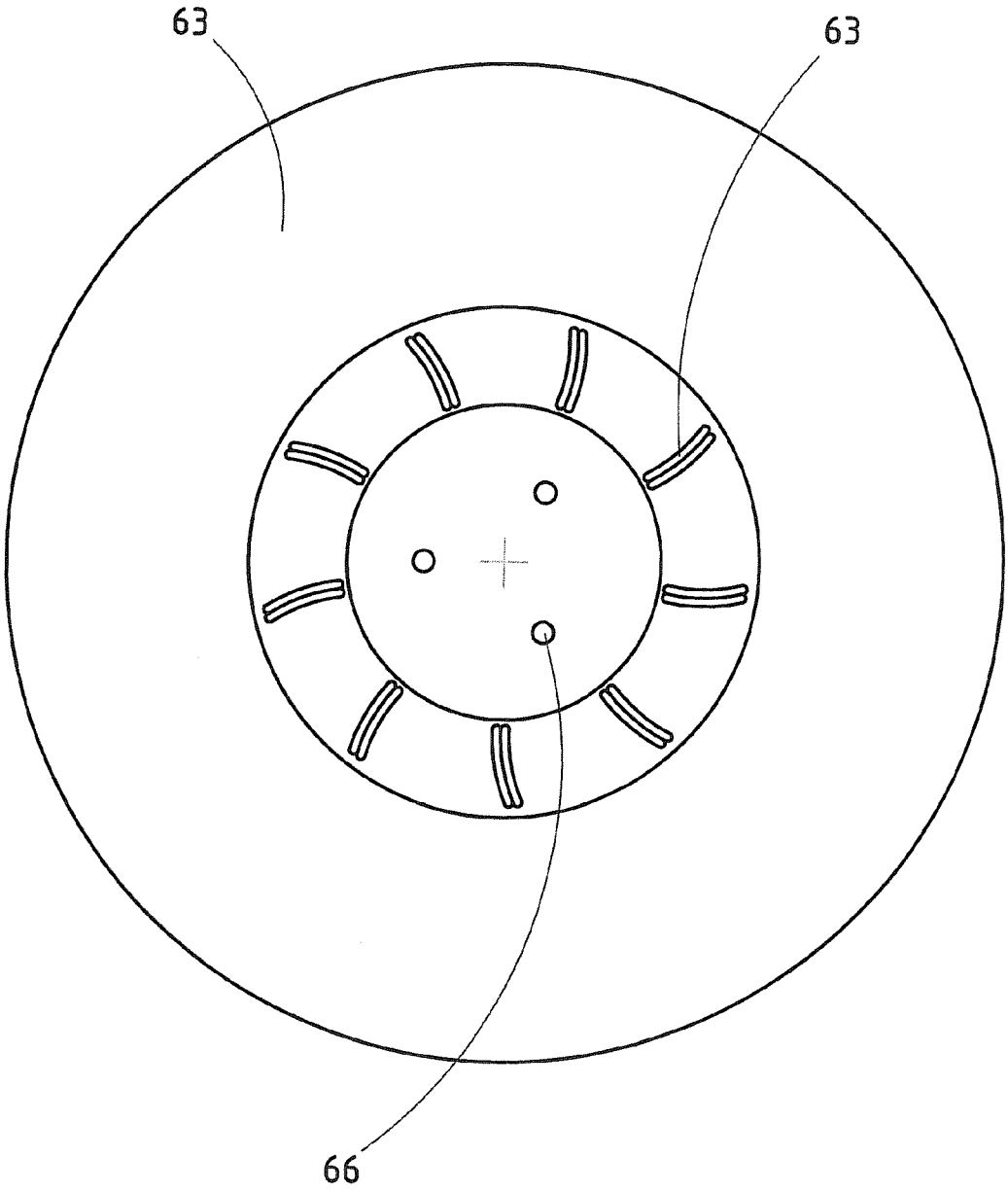
FIG. 15 discloses a plan view of a tool part of the press tool in FIGS. 12-14.

The first tool part 61 also comprises one or several second form elements 66, see FIG. 15, for forming a or several centering members of the pressed blank 90 in order to enable later centering of the blank 90 in connection with a subsequent processing of the blank 90. The form elements 66 are located on the bottom surface, which means that the centering members are provided in a central area of the blank 90. It is also imaginable to provide the centering members in an edge area of the blank 90, wherein corresponding second form elements will be located outside the tapering side surface.

Furthermore, the first tool part 61 comprises a plurality of evacuating passages 67 for evacuation of gas present between the blank 90 and the first tool part 61. The evacuating passages 67 have a very small flow area and are provided to extend through the bottom surface and the surrounding tapering side surface of the first tool part 61. Especially, it is important that there are evacuating passages 67 extending through these surfaces at the first form elements 63 forming the first and second protrusions 31 and 32, and at the second form elements 66 forming the centering member.

The press tool is arranged to permit, in a charging position, introduction of the blank 90 to be pressed between the first tool part 61 and the second tool part 62. Thereafter, the blank 90 is clamped between the first tool part 61 and the holding member 64 see FIG. 12. The first tool part 61 and/or the second tool part 62 are then displaced in a first part step in the direction towards each other to a final position, see FIG. 13. The first part step can be regarded as a mechanical press step. Thereafter, a liquid with a pressure is supplied in a second part step into a space between the blank 90 and the second tool part 62 through the channels 65 in such a way that the blank 90 is pressed to abutment against the first tool part 61 and takes its final shape, see FIG. 14. During the second part step, the gas present between the blank 90 and the first tool part 61 will be evacuated via the evacuating passages 67. The second part step can be regarded as a hydroforming step.

Figure 16:
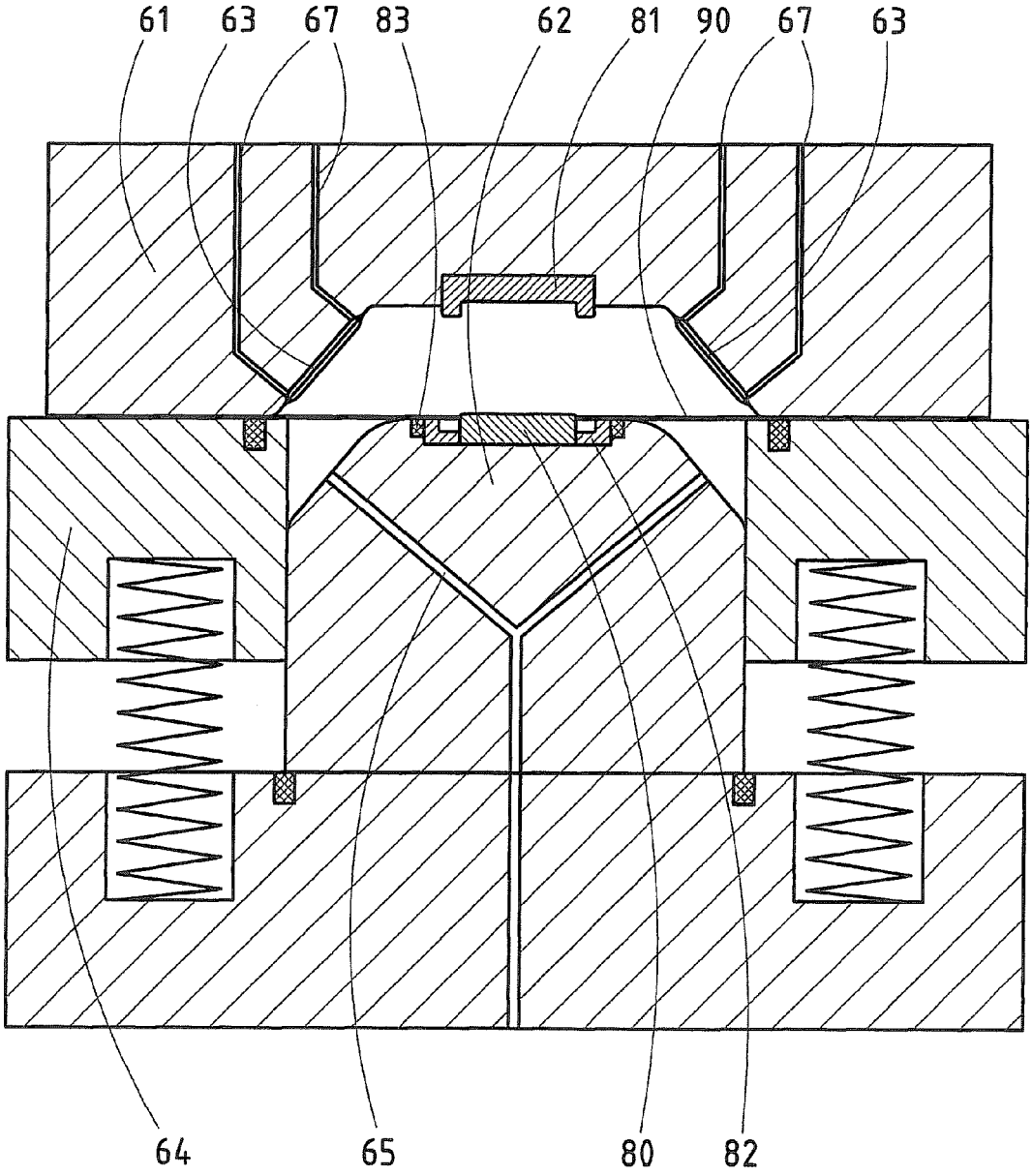
FIG. 16-18 discloses a sectional view of a first variant of a press tool for pressing of a separating disk.
Figure 17:
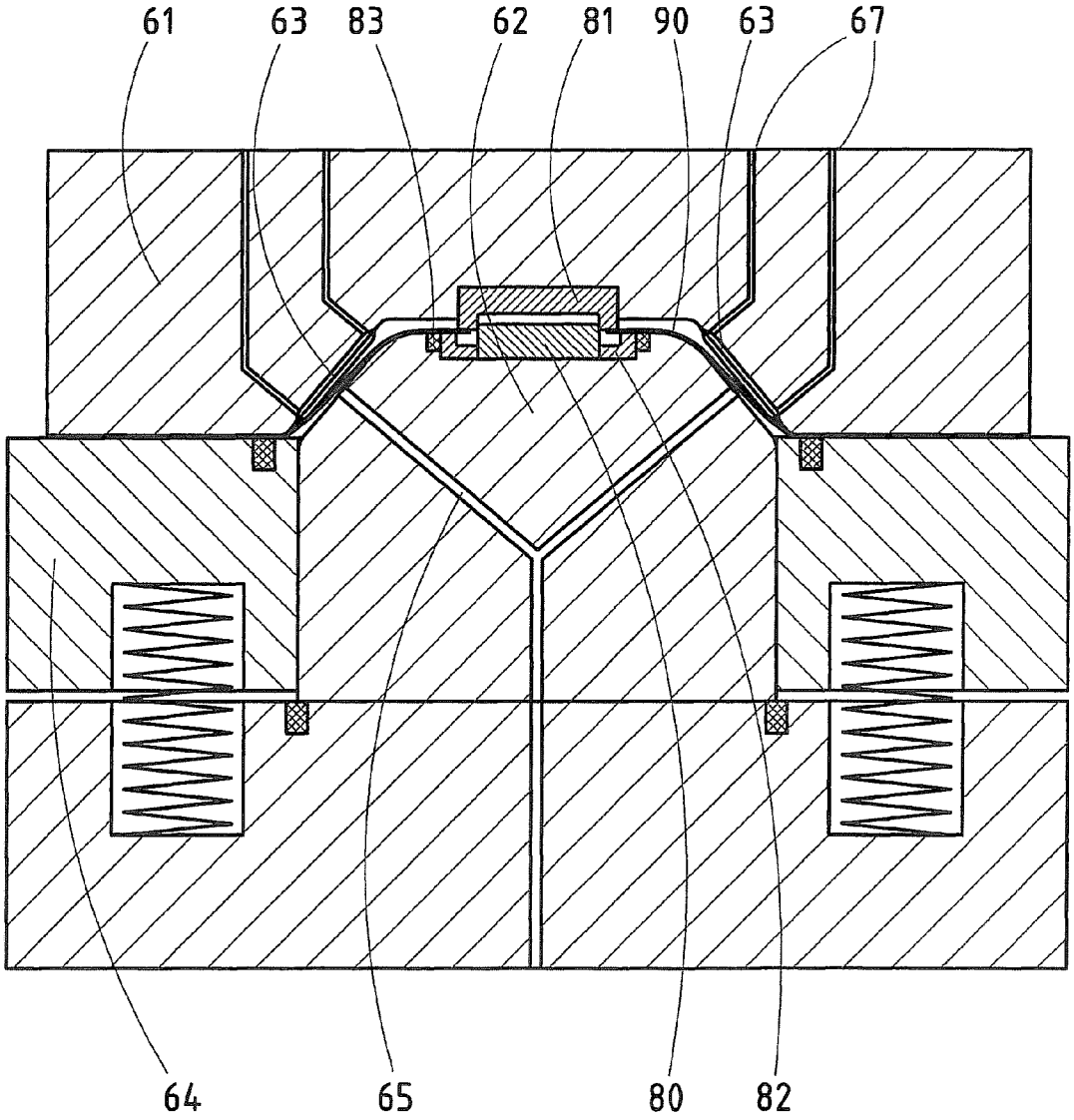
Figure 18:
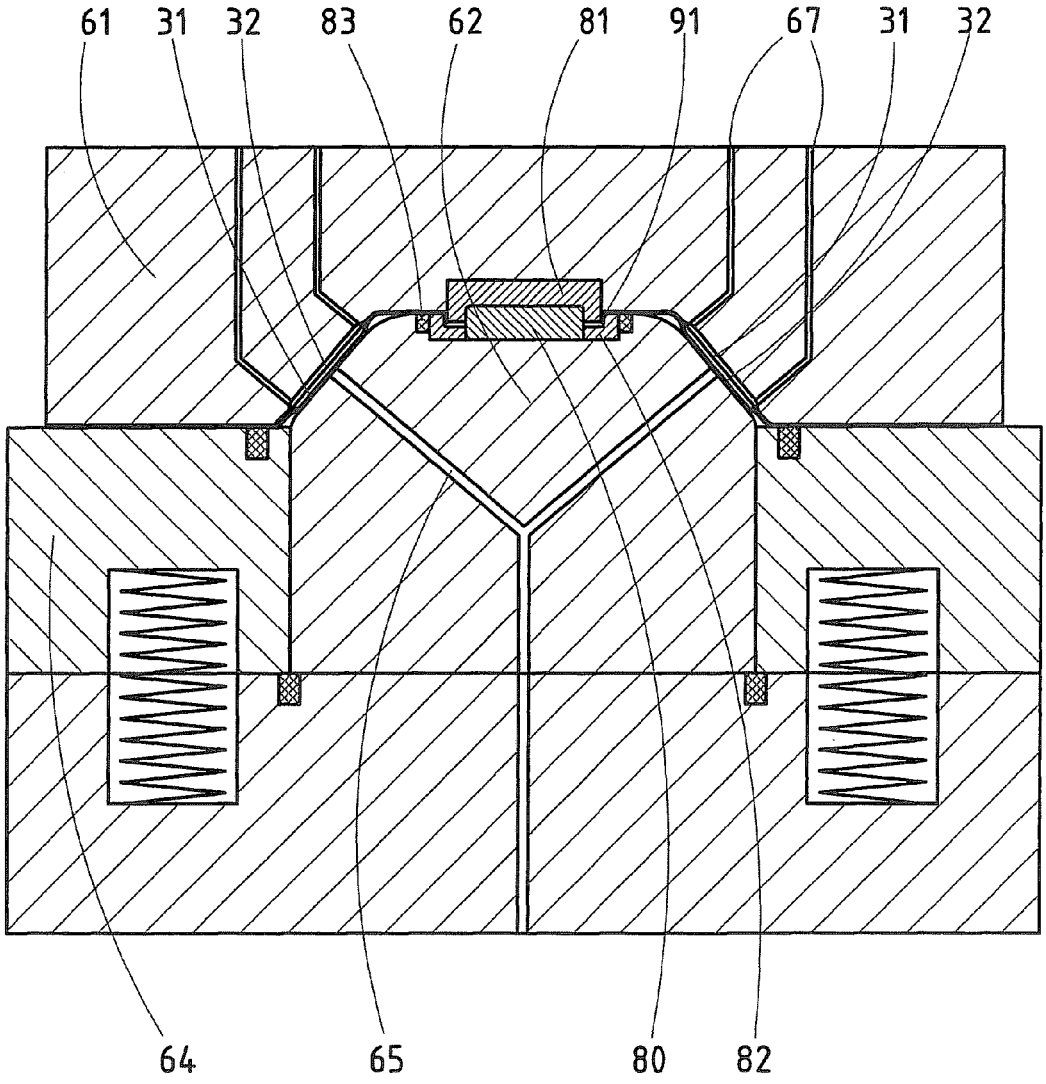
Figure 19:
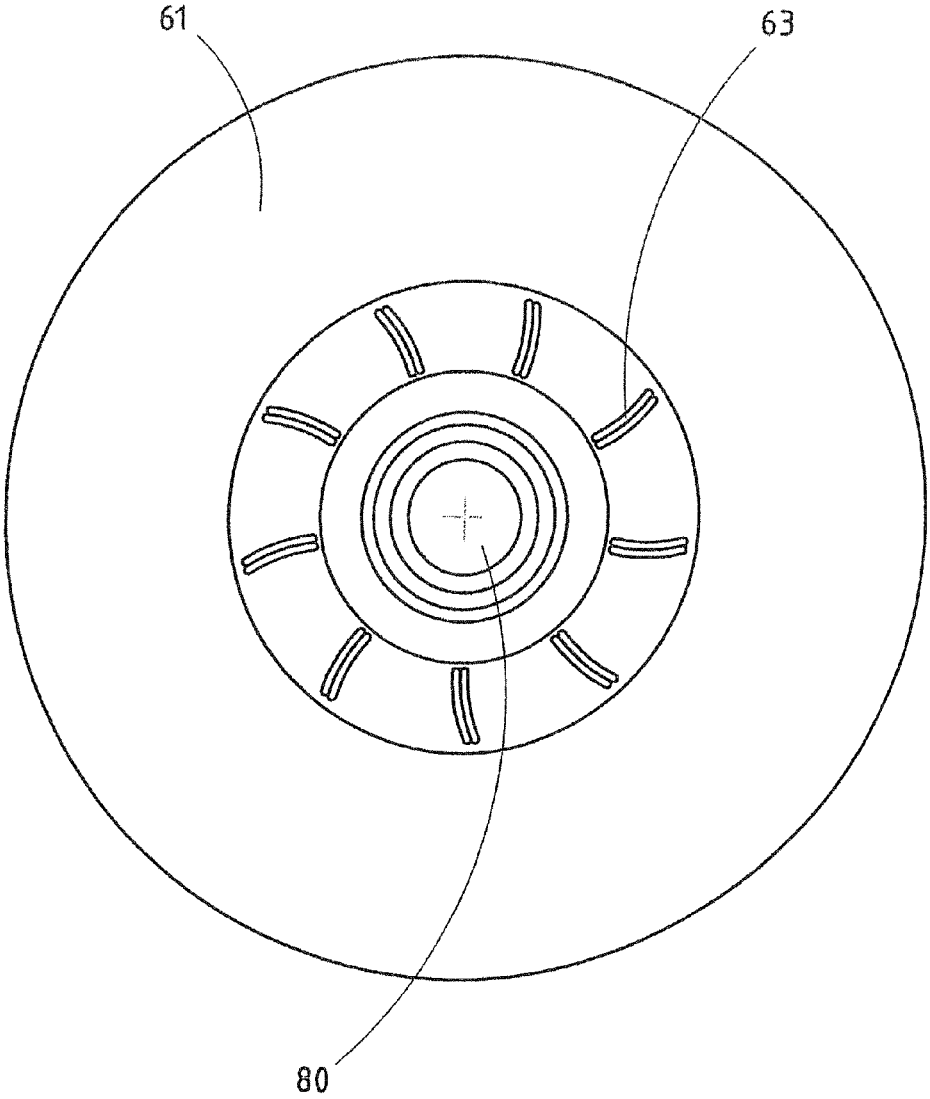
FIG. 19 discloses a plan view of a tool part of the press tool in FIGS. 16-18.

FIGS. 16 to 18 disclose a second variant of a press tool for manufacturing of a separating disk as defined above. The press tool is intended to be introduced in a press (not disclosed) of a suitable design. The press tool comprises a first tool part 61 and a second tool part 62. The first tool part 61 has a concave shape against which the outer surface 21 of the separating disk 20 abuts after finished pressing. The first tool part 61 has a surrounding tapering side surface, in the example disclosed a surrounding substantially conical side surface. The first tool part 61 thus has a shape corresponding to the tapering shape of the pressed separating disk 20. In the case that the separating disk 20 is provided with protrusions 31, 32, 50, the first tool part 61 also comprises first form elements 63, which are located on the surrounding tapering side surface and which correspond to the shape of these protrusions, in the disclosed press tool, the protrusions 31 and 32. The press tool comprises or is associated with a holding member 64 which is arranged to hold the blank to be pressed against the first tool part 61 with a holding force. If the separating disk 20 lacks protrusions, a first part tool 61 without first form elements 63 is used.

The second tool part 62 has a projecting central portion 80 arranged to extend through and engage a central opening of the blank 90 to be pressed. By means of this central portion 80, the blank 90 may be positioned in the press tool before pressing. The first and second tool parts 61 and 62 furthermore have a respective form element 81 and 82, respectively, which in co-operation with each other are arranged to form, when the first and second tool parts 61, 62 are moved towards each other, an area around the central opening in such a way that the material in this area forms a centering member 91 extending cylindrically, or at least partly cylindrically, and concentrically with the axis x of rotation, see FIG. 18. The second tool part 62 also comprises a sealing element 83, which is provided radially outside the projecting central portion 80. The sealing element 83 extends around the central portion at a distance from the latter. The sealing element 83 is arranged to abut sealingly the blank 90 around the central opening. The total press force is reduced thanks to the fact that the centre of the blank 90 inside the sealing element 83 has been masked and thus is not subjected to any pressing. The central portion 80, which positions the blank 90, will also permit guiding of the flow of material in the blank 90 in an initial stage of the pressing with regard to how much material is transported from the centre of the blank 90 and from the peripheral parts of the blank 90. The guiding of the flow of material can be provided by varying the size of the central opening and/or by varying the holding force.

Furthermore, the press tool comprises a supply device arranged to permit supply of a liquid at a pressure between the blank 90 and the second tool part 62. The supply device comprises channels 65 extending through the second tool part 62 through the surface of the second tool part 62 facing the blank 90.

Furthermore, the first tool part 61 comprises a plurality of evacuating passages 67 for evacuating gas present between the blank 90 and the first tool part 61. The evacuating passages 67 have a very small flow area and are provided to extend through the bottom surface and the surrounding tapering side surface of the first tool part 61. Especially, it is important that there are evacuating passages 67 which extend through these surfaces at the first form elements 63 forming the first and second protrusions 31, 32, and at the second form elements 66 forming the centering member.

The press tool is arranged to permit, in a charging position, introduction of the blank 90 to be pressed between the first tool part 61 and the second tool part 62 in such a way that the projecting central portion extends through the central opening. Thereafter, the blank 90 is clamped between the first tool part 61 and the holding member 64, see FIG. 16. The first tool part 61 and/or the second tool part 62 are then displaced in a first part step in a direction towards each other to a final position, see FIG. 17. The first part step can be regarded as a mechanical press step. Thereafter, a liquid at a pressure is supplied in a second part step into a space between the blank 90 and the second tool part 62 through the channels 65 in such a way that the blank 90 is pressed to abutment against the first tool part 61 and takes its final shape, see FIG. 18. The sealing element 83 then prevents the liquid from reaching the central opening. During the second part step, the gas present between the blank 90 and the first tool part 61 will be evacuated via the evacuating passages 67. The second part step can be regarded as a hydroforming step.

After the pressing, the blank 90 is removed from the press tool and transferred to any suitable processing machine (not disclosed). The blank 90 is centered in the processing machine by means of the centering member or members. The processing machine is then arranged to form, in a subsequent processing step, the inner edge 24 and the outer edge 23 of the separating disk 20.

This subsequent processing step comprises forming of the above mentioned one or several recesses 35 along the inner edge 24 and the above mentioned one or several recesses 36 along the outer edge 23. The subsequent processing step may comprise any suitable cutting or shearing operation.

It is to be noted that the first tool part 61 instead of a concave shape may have a convex shape, wherein the inner surface 22 of the separating disk 20 will abut the first tool part 61 after finished pressing.

It is to be noted that the separating disks 20 may be provided with a certain surface roughness on the outer surface and/or the inner surface. Such a surface roughness can be provided through a treatment in advance of the whole, or a part or parts of the outer surface 21 and/or the inner surface 22, for instance in that the actual surface is etched before the separating disk is pressed. The surface roughness will remain after the pressing. It is also imaginable to configure one or both tool parts 61, 62 with a surface roughness, wherein the pressing will provide the desired surface roughness of the actual surface of the outer surface and/or inner surface of the separating disk. Suitable examples of the surface roughness is disclosed in SE-B-457612. The roughness may thus comprise a plurality of flow influencing members having a certain height over the actual surface and a certain mutual distance. The relation between the certain height and the certain distance may lie in the interval 0.2-0.5. As indicated above, it is possible to provide selected parts with a roughness. Different parts of the actual surface may also have different roughness. Advantageously, only one of the outer surface 21 and the inner surface 22 is provided with a roughness. The protrusions 31, 32 suitably have no roughness as well as the surface portions against which the protrusions 31, 32 abut.

The invention is not limited to the embodiments disclosed but may be varied and modified with in the scope of the following claims. Especially, it is to be noted that the described separating disks may be used in substantially all kinds of centrifugal separators, for instance such where the centrifuge rotor has fixed openings for radial discharge of sludge, or intermittently openable such openings, see FIG. 1. The invention is applicable to centrifugal separators adapted for separation of all kinds of media, such as liquids and gases, for instance separating of solid or liquid particles from a gas.

What is claimed is:

1. A separating disk adapted to be included in a disk package of a centrifuge rotor of a centrifugal separator, comprising:

the separating disk having a tapering shape and extending around an axis (x) of rotation and along a tapering rotary symmetric surface (y) along the axis (x) of rotation, wherein the separating disk has an inner surface and an outer surface, wherein the separating disk is manufactured of a material, wherein the separating disk is configured in such a way that it creates an interspace between the separating disk and an adjacent separating disk in the disk package and thus comprises first protrusions extending outwardly from the tapering rotary symmetric surface (y) and second protrusions extending inwardly from the tapering rotary symmetric surface (y), wherein each first and second protrusion defines a contact zone adapted to abut an adjacent separating disk in the disk package, wherein the contact zones of the first protrusions are displaced in relation to the contact zones of the second protrusions seen in a normal direction with regard to the outer surface, wherein the first and second protrusions are provided after each other in a peripheral direction of the centrifugal separator; and wherein the tapering shape and the protrusions of the separating disk have been provided through pressing of a blank of said material against a tool part which has a shape corresponding to the tapering shape with the protrusions of the presses separating disk; and each contact zone has a continuously convex shape seen in a cross-section.

2. A separating disk according to claim 1, wherein the contact zones of the first and second protrusions are provided at a significant distance from each other.

3. A separating disk according to claim 2, wherein the contact zone of a first protrusion is located in the centre between the contact zone of two second protrusions.

4. A separating disk according to claim 1, wherein the protrusions have such an extension in the peripheral direction that each first protrusion adjoins two adjacent second protrusions.

5. A separating disk according to claim 1, wherein the protrusions have such an extension in the peripheral direction that each first protrusion and second protrusion adjoins a portion lacking protrusions and extending along the tapering rotary symmetric surface.

6. A separating disk according to claim 1, wherein each first protrusion is provided immediately adjacent to one of the second protrusions in the peripheral direction.

7. A separating disk according to claim 6, wherein the first protrusion forms a channel-like depression of the inner surface and wherein this depression is configured to permit collection and transport of one of said components radially outwardly on inwardly on the inner surface.

8. A separating disk according to claim 6, wherein the second protrusion forms a channel-like depression of the outer surface and wherein this depression is configured to permit collection and transport of one of said components radially outwardly or inwardly on the outer surface.

9. A separating disk according to claim 1, wherein the first and second protrusions have an extension from in the proximity of the inner edge to in the proximity of the outer edge.

10. A separating disk according to claim 9, wherein the extension of at least some of the first and second protrusions is curved.

11. A disk package for a centrifuge rotor of a centrifugal separator, wherein the disk package comprises a plurality of separating disks with a plurality of first separating disks and a plurality of second separating disks, wherein each separating disk has a tapering shape and extends around an axis (x) of rotation and along a tapering rotary symmetric surface (y) along the axis (x) of rotation, wherein each separating disk has an inner surface and an outer surface, wherein each separating disk is manufactured of a material, wherein each first separating disk is configured in such a way that it creates interspaces between the first separating disk and an adjacent separating disk in the disk package and thus comprises first protrusions extending outwardly form the tapering rotary symmetric surface (y) and second protrusions extending inwardly from the tapering rotary symmetric surface (y), wherein each first and second protrusion defines a contact zone adapted to abut an adjacent separating disk in the disk package, wherein the contact zones of the first protrusions are displaced in relation to the contact zones of the second protrusions seen in a normal direction with regard to the outer surface, wherein the first and second protrusions are provided after each other in a peripheral direction of the first separating disk, the tapering shape and the protrusions of the separating disks have been provided through pressing of a blank of said material against a tool part having a shape corresponding to the tapering shape with the protrusions of the pressed separating disk;

the first and second separating disks are provided in an alternating order in the disk package;

the second separating disk lack distance members; and the second separating disks are provided with a plastically deformed portion against which the contact zone of one of the first and/or second protrusions abuts.

12. A separating disk adapted to be included in a disk package of a centrifuge rotor of a centrifugal separator, comprising:

the separating disk having a tapering shape and extending around an axis (x) of rotation and along a tapering rotary symmetric surface (y) along the axis (x) of rotation, wherein the separating disk has an inner surface and an outer surface, wherein the separating disk is manufactured of a material, wherein the separating disk is configured in such a way that it creates an interspace between the separating disk and an adjacent separating disk in the disk package and thus comprises first protrusions extending outwardly from the tapering rotary symmetric surface (y) and second protrusions extending inwardly from the tapering rotary symmetric surface (y), wherein each first and second protrusion defines a contact zone adapted to abut an adjacent separating disk in the disk package, wherein the contact zones of the first protrusions are displaced in relation to the contact zones of the second protrusions seen in a normal direction with regard to the outer surface, wherein the first and second protrusions are provided after each other in a peripheral direction of the centrifugal separator; and wherein the tapering shape and the protrusions of the separating disk have been provided through pressing of a blank of said material against a tool part which has a shape corresponding to the tapering shape with the protrusions of the presses separating disk; and the protrusions have such an extension in the peripheral direction that each first protrusion adjoins to adjacent second protrusions.

13. A separating disk adapted to be included in a disk package of a centrifuge rotor of a centrifugal separator, comprising:

the separating disk having a tapering shape and extending around an axis (x) of rotation and along a tapering rotary symmetric surface (y) along the axis (x) of rotation, wherein the separating disk has an inner surface and an outer surface, wherein the separating disk is manufactured of a material, wherein the separating disk is configured in such a way that it creates an interspace between the separating disk and an adjacent separating disk in the disk package and thus comprises first protrusions extending outwardly from the tapering rotary symmetric surface (y) and second protrusions extending inwardly from the tapering rotary symmetric surface (y), wherein each first and second protrusion defines a contact zone adapted to abut an adjacent separating disk in the disk package, wherein the contact zones of the first protrusions are displaced in relation to the contact zones of the second protrusions seen in a normal direction with regard to the outer surface, wherein the first and second protrusions are provided after each other in a peripheral direction of the centrifugal separator; and wherein the tapering shape and the protrusions of the separating disk have been provided through pressing of a blank of said material against a tool part which has a shape corresponding to the tapering shape with the protrusions of the presses separating disk; and each first protrusion is provided immediately adjacent to one of the second protrusions in the peripheral direction.

14. A separating disk adapted to be included in a disk package of a centrifuge rotor of a centrifugal separator, comprising:

the separating disk having a tapering shape and extending around an axis (x) of rotation and along a tapering rotary symmetric surface (y) along the axis (x) of rotation, wherein the separating disk has an inner surface and an outer surface, wherein the separating disk is manufactured of a material, wherein the separating disk is configured in such a way that it creates an interspace between the separating disk and an adjacent separating disk in the disk package and thus comprises first protrusions extending outwardly from the tapering rotary symmetric surface (y) and second protrusions extending inwardly from the tapering rotary symmetric surface (y), wherein each first and second protrusion defines a contact zone adapted to abut an adjacent separating disk in the disk package, wherein the contact zones of the first protrusions are displaced in relation to the contact zones of the second protrusions seen in a normal direction with regard to the outer surface, wherein the first and second protrusions are provided after each other in a peripheral direction of the centrifugal separator; and wherein the tapering shape and the protrusions of the separating disk have been provided through pressing of a blank of said material against a tool part which has a shape corresponding to the tapering shape with the protrusions of the presses separating disk; and the first and second protrusions have an extension from in the proximity of the inner edge to in the proximity of the outer edge.

15. A separating disk according to claim 14, wherein the extension of at least some of the first and second protrusions is straight.

* * * * *